US011162155B2

(12) United States Patent
Park et al.

(10) Patent No.: US 11,162,155 B2
(45) Date of Patent: Nov. 2, 2021

(54) NON-ORIENTED ELECTRICAL STEEL SHEET AND METHOD FOR PRODUCING SAME

(71) Applicant: POSCO, Pohang-si (KR)

(72) Inventors: June Soo Park, Pohang-si (KR); Dae Hyun Song, Pohang-si (KR)

(73) Assignee: POSCO, Pohang-si (KR)

( * ) Notice: Subject to any disclaimer, the term of this patent is extended or adjusted under 35 U.S.C. 154(b) by 152 days.

(21) Appl. No.: 16/472,168

(22) PCT Filed: Dec. 20, 2017

(86) PCT No.: PCT/KR2017/015126

§ 371 (c)(1),
(2) Date: Jun. 20, 2019

(87) PCT Pub. No.: WO2018/117640

PCT Pub. Date: Jun. 28, 2018

(65) Prior Publication Data

US 2019/0345576 A1 Nov. 14, 2019

(30) Foreign Application Priority Data

Dec. 20, 2016 (KR) ..... 10-2016-0174362

(51) Int. Cl.

| | |
|---|---|
| ***C21D 9/46*** | (2006.01) |
| ***C21D 8/12*** | (2006.01) |
| ***C21D 8/00*** | (2006.01) |
| ***C21D 6/00*** | (2006.01) |
| ***C22C 38/14*** | (2006.01) |
| ***C22C 38/06*** | (2006.01) |
| ***C22C 38/04*** | (2006.01) |
| ***C22C 38/02*** | (2006.01) |
| ***C22C 38/00*** | (2006.01) |
| ***H01F 1/147*** | (2006.01) |

(52) U.S. Cl.

CPC ..... *C21D 9/46* (2013.01); *C21D 6/005* (2013.01); *C21D 6/008* (2013.01); *C21D 8/005* (2013.01); *C21D 8/1222* (2013.01); *C21D 8/1233* (2013.01); *C21D 8/1272* (2013.01); *C22C 38/001* (2013.01); *C22C 38/002* (2013.01); *C22C 38/008* (2013.01); *C22C 38/02* (2013.01); *C22C 38/04* (2013.01); *C22C 38/06* (2013.01); *C22C 38/14* (2013.01); *H01F 1/14775* (2013.01); *C21D 2241/00* (2013.01); *C22C 2202/02* (2013.01)

(58) Field of Classification Search

CPC .... C21D 2241/00; C21D 6/005; C21D 6/008; C21D 8/005; C21D 8/0273; C21D 8/12; C21D 8/1222; C21D 8/1233; C21D 8/1272; C21D 9/46; C22C 2202/02; C22C 38/001; C22C 38/002; C22C 38/004; C22C 38/008; C22C 38/02; C22C 38/04; C22C 38/06; C22C 38/14; C22C 38/32; C22C 38/34; C22C 38/60; H01F 1/14775; H01F 1/16

See application file for complete search history.

(56) References Cited

U.S. PATENT DOCUMENTS

| | | | |
|---|---|---|---|
| 4,863,531 | A | 9/1989 | Wada et al. |
| 5,186,766 | A | 2/1993 | Iriyama et al. |

FOREIGN PATENT DOCUMENTS

| | | | |
|---|---|---|---|
| CN | 1188811 | A | 7/1998 |
| CN | 1078625 | C | 1/2002 |
| CN | 1361305 | A | 7/2002 |
| CN | 1505821 | A | 6/2004 |
| CN | 101641455 | A | 2/2010 |
| CN | 103060680 | A | 4/2013 |
| CN | 104884642 | A | 9/2015 |
| CN | 105993053 | A | 10/2015 |
| CN | 105849300 | A | 8/2016 |
| CN | 106030869 | A | 10/2016 |
| EP | 0837148 | A2 | 4/1998 |
| JP | S62-156208 | A | 7/1987 |
| JP | S63-130747 | A | 6/1988 |
| JP | H05-132742 | A | 5/1993 |
| JP | 2001-335897 | A | 12/2001 |
| JP | 2002-012956 | A | 1/2002 |
| JP | 2002-343657 | A | 11/2002 |
| JP | 2005-264315 | A | 9/2005 |
| JP | 2006-117515 | A | 5/2006 |
| JP | 2006-265720 | A | 10/2006 |
| JP | 2007-023351 | A | 2/2007 |
| JP | 2007-031793 | A | 2/2007 |
| JP | 2007-177282 | A | 7/2007 |
| JP | 2008-127612 | A | 6/2008 |
| JP | 2008-143720 | A | 6/2008 |
| JP | 2009-102739 | A | 5/2009 |
| JP | 2011-132558 | A | 7/2011 |

(Continued)

OTHER PUBLICATIONS

International Search Report and Written Opinion dated Apr. 4, 2018 issued in International Patent Application No. PCT/KR2017/015126 (with partial English translation).

Extended European Search Report dated Oct. 11, 2019 issued in European Patent Application No. 17883586.4.

"Standard Practice for Using Significant Digits in Test Data to Determine Conformance with Specifications," An American National Standard, Jan. 1, 2013 (5 pages).

Chinese Search Report cited in Chinese Office Action dated Jul. 21, 2020 issued in Chinese Patent Application No. 201780079209.3.

(Continued)

*Primary Examiner* — Jenny R Wu

(74) *Attorney, Agent, or Firm* — Morgan, Lewis & Bockius LLP

(57) ABSTRACT

A non-grain oriented electrical steel sheet according to an exemplary embodiment of the present invention includes Si: 1.0 to 4.0%, Mn: 0.1 to 1.0%, Al: 0.1 to 1.5%, Zn: 0.001 to 0.01% B: 0.0005 to 0.005%, and a balance including Fe and inevitable impurities.

10 Claims, No Drawings

(56) References Cited

FOREIGN PATENT DOCUMENTS

| | | | | |
|---|---|---|---|---|
| JP | 4779474 | B2 | | 9/2011 |
| JP | 2011-216571 | A | | 10/2011 |
| JP | 2016-156044 | A | | 9/2016 |
| JP | 2016156044 | A | * | 9/2016 |
| KR | 10-1990-0008852 | B1 | | 12/1990 |
| KR | 10-1997-0043173 | A | | 7/1997 |
| KR | 10-2001-0028570 | A | | 4/2001 |
| KR | 20010028570 | A | * | 4/2001 |
| KR | 10-0479992 | B1 | | 3/2005 |

OTHER PUBLICATIONS

"Research and development and innovation of process technology of cold-rolled non-oriented silicon steel," May 1, 2004, pp. 83-86.
K. Kusaka, et al., "Effects of boron and silicon on magnetic properties of iron silicon magnet alloys," Metal Power Report, Oct. 31, 2002 No. 43, pp. 1-12 (Abstract only).

* cited by examiner

NON-ORIENTED ELECTRICAL STEEL SHEET AND METHOD FOR PRODUCING SAME

CROSS-REFERENCE OF RELATED APPLICATIONS

This application is the U.S. National Phase under 35 U.S.C. § 371 of International Patent Application No. PCT/KR2017/015126, filed on Dec. 20, 2017, which in turn claims the benefit of Korean Application No. 10-2016-0174362, filed on Dec. 20, 2016, the entire disclosures of which applications are incorporated by reference herein.

TECHNICAL FIELD

The present disclosure relates to a non-grain oriented electrical steel sheet and a manufacturing method thereof. In detail, the present disclosure relates to a non-grain oriented electrical steel sheet, in which iron loss and a magnetic flux density are simultaneously excellent, and a manufacturing method thereof.

BACKGROUND ART

A non-grain oriented electrical steel sheet is used as a material for an iron core in rotating equipment such as motors and generators, and stationary devices such as small transformers, and it converts electrical energy into mechanical energy. Therefore, there is a growing demand for the non-grain oriented electrical steel sheets having excellent characteristics for energy reduction as a very important material for determining the energy efficiency of electrical devices. In the non-grain oriented electrical steel sheets, iron loss and magnetic flux density are very important characteristics. The iron loss is the energy lost in an energy conversion process, so the lower the better, and the magnetic flux density is related to the output, so the higher the better. Recently, for high efficiency characteristics required for electric motors and generators, a non-grain oriented electrical steel sheet with excellent magnetic properties simultaneously having low iron loss and high magnetic flux density characteristics has been required. The most effective method for lowering the iron loss is to increase the specific resistance of the steel by increasing the addition amount of Si, Al, and Mn, which are the main additive elements of the non-oriented electrical steel sheet, however since the increase of the addition amount of the alloy elements has a disadvantage of decreasing the magnetic flux density and decreasing productivity, a technology has been developed in the direction of simultaneously improving the iron loss and the magnetic flux density through derivation of an optimum addition amount. In order to improve the magnetic properties, improving the texture of the aggregate by utilizing special additive elements such as REM, or introducing an additional manufacturing process such as annealing twice and rolling twice, has been used. However, these techniques cause a rise in manufacturing cost and difficulty in mass production. In order to solve these problems, a composition weight ratio ($MnO/SiO_2$) of MnO and $SiO_2$ in oxide series inclusions in the steel is controlled to improve the magnetic properties through improvement of the texture of the aggregate, and a method of hot-rolled sheet annealing, cold rolling, and cold-rolled sheet annealing after a finishing rolling during hot rolling is performed in a ferrite single phase region having a friction coefficient between the steel and the roll of 0.2 or less and a finish rolling temperature of 700° C. or more has been proposed. However, in this case, since the heat rolled sheet thickness should be controlled to 1.0 mm or less, there are problems that the productivity is reduced and commercial production is difficult. In addition, for the manufacture of the non-grain oriented electrical steel sheet with excellent magnetic properties in the rolling direction, a process of skin pass rolling with a reduction ratio of 3 to 10% and annealing again has been proposed, in addition to the process of the hot rolling, the heat rolled sheet annealing, the cold rolling, and the cold rolled sheet annealing. This also has a problem of the cost increase due to the additional process. In order to improve the magnetic properties, a method of rolling twice and annealing twice, including intermediate annealing, with the heat rolled sheet has been proposed, and a method of rolling twice including the intermediate annealing during the cold rolling has been proposed, however this also has the problem that the manufacturing cost is increased due to the addition of the rolling-annealing process.

DISCLOSURE

An exemplary embodiment of the present invention provides a non-grain oriented electrical steel sheet and a manufacturing method thereof.

In detail, the non-grain oriented electrical steel sheet of which an iron loss and a magnetic flux density are simultaneously excellent is provided.

A non-grain oriented electrical steel sheet according to an exemplary embodiment of the present invention includes Si: 1.0 to 4.0%, Mn: 0.1 to 1.0%, Al: 0.1 to 1.5%, Zn: 0.001 to 0.01%, B: 0.0005 to 0.005%, and a balance including Fe and inevitable impurities.

P: 0.001 to 0.1 wt %, C: 0.005 wt % or less, S: 0.001 to 0.005 wt %, N: 0.005 wt % or less, and Ti: 0.005 wt % or less may be further included.

One or more of Sn and Sb alone or in a sum amount of 0.06 wt % or less may be further included.

One or more of Cu: 0.05 wt % or less, Ni: 0.05 wt % or less, Cr: 0.05 wt % or less, Zr: 0.01 wt % or less, Mo: 0.01 wt % or less, and V: 0.01 wt % or less may be further included.

For a steel sheet surface, a density of a Si oxide with a particle diameter of 50 to 200 nm may be 5 units/$\mu m^2$ or less.

An iron loss ($W_{15/50}$) may be 2.80 W/kg or less, and a magnetic flux density $B_{50}$ is 1.70 T or more.

A manufacturing method of a non-grain oriented electrical steel sheet according to an exemplary embodiment of the present invention includes: a step of heating a slab including Si: 1.0 to 4.0%, Mn: 0.1 to 1.0%, Al: 0.1 to 1.5%, Zn: 0.001 to 0.01%, B: 0.0005 to 0.005%. and a balance including Fe and inevitable impurities by wt %; a step of hot-rolling the slab to manufacturing a heat rolled sheet; a step of cold rolling the heat rolled sheet to manufacturing a cold rolled sheet; and a step of final annealing the cold rolled sheet.

The slab may further include P: 0.001 to 0.1 wt %, C: 0.005 wt % or less, S: 0.001 to 0.005 wt %, N: 0.005 wt % or less, and Ti: 0.005 wt % or less.

The slab may further include one kind or more of Sn and Sb alone or a sum amount of 0.06 wt % or less.

The slab may further include one kind or more of Cu: 0.05 wt % or less, Ni: 0.05 wt % or less, Cr: 0.05 wt % or less, Zr: 0.01 wt % or less, Mo 0.01 wt % or less, and V: 0.01 wt % or less.

After the step of manufacturing the heat rolled sheet, a step of annealing the heat rolled sheet may be further included.

The step of the final annealing may include using hydrogen gas as an atmosphere gas, and a content ratio of the hydrogen gas within the atmosphere gas may satisfy the following Equation 1.

$$0.01 \leq ([Zn]+[B]) \times 100/[H_2] \leq 0.06 \quad \text{[Equation 1]}$$

(In Equation 1, [Zn] and [B] represent each content (wt %) of Zn and B, and $[H_2]$ represents a content (volume %) of hydrogen gas within an atmosphere (gas.)

The non-grain oriented electrical steel sheet and the manufacturing method according to an exemplary embodiment of the present invention may provide the non-grain oriented electrical steel sheet simultaneously having excellent magnetic flux density and excellent iron loss.

MODE FOR INVENTION

The terms "first", "second", and "third" are used herein to explain various parts, components, regions, layers, and/or sections, but it should be understood that they are not limited thereto. These terms are used only to discriminate one portion, component, region, layer, or section from another portion, component, region, layer, or section. Thus, a first portion, component, region, layer, or section may be referred to as a second portion, component, region, layer, or section without departing from the scope of the present invention.

The technical terms used herein are to simply mention a particular embodiment and are not meant to limit the present invention. An expression used in the singular encompasses the expression of the plural, unless it has a clearly different meaning in the context. The term "including" used herein embodies concrete specific characteristics, regions, positive numbers, steps, operations, elements, and/or components, without limiting existence or addition of other specific characteristics, regions, positive numbers, steps, operations, elements, and/or components.

It will be understood that when an element such as a layer, film, region, or substrate is referred to as being "on" or "above" another element, it can be directly on or above the other element or intervening elements may also be present. In contrast, when an element is referred to as being "directly on" another element, there are no intervening elements therebetween.

If not defined differently, all the terminologies including technical terminologies and scientific terminologies used herein have meanings that are the same as ones that those skilled in the art generally understand. The terms defined in dictionaries should be construed as having meanings corresponding to the related prior art documents and those stated herein, and are not to be construed as being idealized or official, if not so defined.

Unless otherwise stated, % means wt %, and 1 ppm is 0.0001 wt %.

In an exemplary embodiment of the present invention, a further inclusion of an additional element means that an additional amount of the additional element is included in place of iron (Fe), which is a balance.

Hereinafter, exemplary embodiments of the present invention will be described in detail so as to be easily practiced by a person skilled in the art to which the present invention pertains. As those skilled in the art would realize, the described embodiments may be modified in various different ways, all without departing from the spirit or scope of the present invention.

A non-grain oriented electrical steel sheet according to an exemplary embodiment of the present invention includes Si: 1.0 to 4.0%, Mn: 0.1 to 1.0%, Al: 0.1 to 1.5%, Zn: 0.001 to 0.01%, B: 0.0005 to 0.005%, and a balance including Fe and inevitable impurities by wt %.

P: 0.001 to 0.1 wt %, C: 0.005 wt % or less, S: 0.001 to 0.005 wt %, N: 0.005 wt % or less, and Ti: 0.005 wt % or less may be further included.

One kind or more of Sn and Sb may be further included at 0.06 wt % or less by itself or as a sum amount.

One kind or more among Cu: 0.05 wt % or less, Ni: 0.05 wt % or less, Cr: 0.05 wt % or less, Zr: 0.01 wt % or less, Mo: 0.01 wt % or less, and V: 0.01 wt % or less may be further included.

First, reasons for a component limitations of the non-grain oriented electrical steel sheet are described.

Si: 1.0 to 4.0 wt %

Silicon (Si) is a major element added to reduce eddy current loss during iron loss by increasing specific resistance of the steel. If too little added, the iron loss improvement effect may be insufficient. Conversely, if too much is added, the magnetic flux density may be reduced and a rolling property may be poor. Therefore, Si may be added in the above-described range.

Mn: 0.1 to 1.0 wt %

Manganese (Mn) is added to reduce the iron loss by increasing specific resistance along with Si, Al, etc., and there is an effect of improving texture of the aggregate. If the addition amount is too small, the effect on the magnetism is insufficient, and if the addition amount is too large, the magnetic flux density may be greatly deteriorated. Therefore, Mn may be added in the above-described range.

Al: 0.1 to 1.5 wt %

Aluminum (Al), like Si, plays a role in reducing the iron loss by increasing the specific resistance. Adding too much may greatly reduce the magnetic flux density. Therefore, Al may be added in the range described above. More specifically, Al may be contained in an amount of 0.1 to 1.0 wt %.

Zn: 0.001 to 0.01 wt %

If the contained amount of zinc (Zn) is excessive, it acts as an impurity and dislocates the magnetism, and conversely, if the content is too low, the effect on magnetism is insignificant. Therefore, Zn may be added in the above-described range.

B: 0.0005 to 0.005 wt %

Boron (B) is an element that binds strongly with N, and is an element added to suppress a formation of a nitride with Ti, Nb, Al, and the like. If the addition amount is too small, the effect is insufficient, and if the addition amount is excessively large, the magnetic property may be reduced by a BN compound itself. Therefore, B may be added in the above-described range.

P: 0.001 to 0.1 wt %

Phosphorus (P) plays a role in lowering the iron loss by increasing the specific resistance and improving the texture of the aggregate by segregating in the grain boundary. However, P may be added in the above range because it is an element which lowers the rolling property in a high alloy steel.

C: 0.005 wt % or less

It is preferred that a low amount of carbon (C) is contained because carbon (C) is combined with Ti to form a carbide such that the magnetism may be reduced, and it increases the iron loss due to magnetic aging when it is used after an electrical product is processed in the final product. When C is further added, the C may be added in the above-mentioned range.

S: 0.001 to 0.005 wt %

It is preferred to add as low amount as possible because sulfur (S) is an element which forms sulfides such as MnS, CuS and (Cu, Mn)S, which are harmful to the magnetic characteristic. However, if too little is added, the magnetism may be deteriorated due to the disadvantage of forming the texture of the aggregate. If too much is added, the magnetism may be reduced due to the increase of fine sulfides. Therefore, when S is further added, the S may be added in the above-described range.

N: 0.005 wt % or less

Nitrogen (N) is an element which is harmful to the magnetism by suppressing crystal grain growth by forming a nitride by strong bonding with Al, Ti, etc., so it is preferably as small an amount as possible. When N is further added, the N may be added in the above-mentioned range.

Ti: 0.005 wt % or less

Titanium (Ti) suppresses the crystal grain growth by forming fine carbides and nitrides. As the amount increases, the magnetization becomes poor due to the decreased texture of the aggregate due to increased carbides and nitrides. When Ti is further added, the Ti can be added in the above-mentioned range.

Sn and Sb: 0.06 wt % or less

Tin (Sn) and antimony (Sb) are grain boundary segregation elements, and are added to improve the magnetic properties by suppressing the diffusion of nitrogen through the grain boundaries, suppressing the formation of the {111}, {112} texture of the aggregate, which is harmful to the magnetism, and increasing the {100} and {110} texture of the aggregate, which is advantageous to the magnetism, however if the addition amount is small, the effect is not large, and if the addition amount is large, the magnetic property is decreased by suppressing the crystal grain growth. When Sn or Sb is added, it may be contained at 0.06 wt % or less individually or in a sum amount. That is, when Sn is included alone, 0.06 wt % or less of Sn may be included, when Sb is included alone, 0.06 wt % or less of Sb may be included, when Sn and Sb are included, 0.06 wt % or less may be included as the sum amount of Sn and Sb.

Impurity elements

In addition to the above-described elements, inevitably incorporated impurities such as Cu, Ni, Cr, Zr, Mo, and V may be included. In case of Cu, Ni, or Cr, it reacts with impurity elements to form fine sulfides, carbides, and nitrides, which have a harmful effect on the magnetism. Therefore, these contents are limited to 0.05 wt % or less, respectively. Since Zr, Mo, V, and the like are also strong carbonitride forming elements, they are preferably not added if possible and are respectively contained in the amount of 0.01 wt % or less.

The non-grain oriented electrical steel sheet formed by an exemplary embodiment of the present invention controls the density of Si oxide formed on the steel sheet surface by precisely controlling the content of Zn and B, and ultimately the iron loss and the magnetic flux density are simultaneously improved. Specifically, for the steel sheet surface, a density of a Si oxide with a particle diameter of 50 to 200 nm may be 5 units/$\mu m^2$ or less. In this case, the steel sheet surface means a surface layer perpendicular to the steel sheet thickness direction. A Si oxide with a particle diameter of less than 50 nm has a negligible effect on the magnetism and is excluded from the evaluation of the density. A Si oxide with a particle diameter of greater than 200 nm is also excluded because its effect on the magnetism is negligible. By controlling the density of the Si oxide, the non-grain oriented electrical steel sheet is obtained while having excellent iron loss and magnetic flux density. In detail, the iron loss ($W_{15/50}$) may be 2.80 W/kg or less, and the magnetic flux density $B_{50}$ may be 1.70 T or more.

A manufacturing method of a non-grain oriented electrical steel sheet according to an exemplary embodiment of the present invention includes: a step of heating a slab including Si: 1.0 to 4.0%, Mn: 0.1 to 1.0%, Al: 0.1 to 1.5%, Zn: 0.001 to 0.01%, B: 0.0005 to 0.005%, and a balance including Fe and inevitable impurities; a step of manufacturing a heat rolled sheet by hot-rolling the slab; a step of manufacturing a cold rolled sheet by cold rolling the heat rolled sheet; and a step of finally annealing the cold rolled sheet. Hereinafter, each step is described in detail.

First, the slab is heated. The reason for limiting the addition ratio of each composition in the slab is the same as the reason for the composition limitation of the non-grain oriented electrical steel sheet described above, and therefore the repeated description is omitted. In the manufacturing process of the hot rolling, the heat rolled sheet annealing, the cold rolling, the final annealing, the like to be described later, since the composition of the slab is not substantially changed, the composition of the slab and the composition of the non-grain oriented electrical steel sheet are substantially the same.

The slab is charged into a heating furnace and heated at 1100 to 1200° C. When being heated at a temperature exceeding 1200° C., precipitates such as AlN, MnS, etc., existing in the slab are re-employed and then minutely precipitated during the hot rolling, thereby suppressing the crystal grain growth and deteriorating the magnetism.

The heated slab is hot-rolled to 2 to 2.3 mm to manufacture a heat rolled sheet. The finish rolling during the hot rolling may be performed with a final reduction ratio of 20% or less for correction of a plate profile. The heat rolled sheet is spiral-wound at less than 700° C. and cooled in air.

After the step of manufacturing the heat rolled sheet, a step of annealing the heat rolled sheet may be further included. At this time, the annealing temperature of the heat rolled sheet may be 1000 to 1200° C. If the heat rolled sheet annealing temperature is too low, the crystal grain growth is insufficient and the magnetism is inferior, and if the annealing temperature is too high, the crystal grain may coagulate and the cold rolling property may become dull.

Next, the heat rolled sheet is pickled and cold rolled to have a predetermined plate thickness. It may be applied differently depending on the heat rolled sheet thickness, but the cold rolled sheet may be manufactured by cold rolling so as to have a final thickness of 0.10 to 0.70 mm by applying a reduction ratio of 50 to 95%. If necessary, a plurality of cold rolling processes, including the intermediate annealing, may be included.

The cold rolled sheet that is finally cold rolled is subjected to the final annealing. The final annealing temperature may be from 750 to 1050° C. If the final annealing temperature is too low, the recrystallization does not occur sufficiently, and if the final annealing temperature is too high, the rapid growth of the crystal grain may occur such that the magnetic flux density and the high-frequency iron loss may be deteriorated. More specifically, the final annealing may be performed at a temperature of 900 to 1000° C.

In the final annealing step, hydrogen gas may be included as an atmosphere gas. The remainder may be nitrogen gas. At this time, a content of Zn and B in the slab and a content of hydrogen gas in the atmosphere gas may be controlled. Si and Al serve to reduce the iron loss by increasing the specific resistance of the steel and the tendency is to increase the addition amount for the low iron loss characteristic, however as Si reacts with oxygen during the annealing to form an oxide on the surface of the base material, the magnetism is deteriorated by disrupting the migration of the magnetic domain in the magnetization process, and Al also reacts with oxygen and nitrogen to form an oxide or a nitride, thereby similarly deteriorating the magnetism. Therefore, it is necessary to suppress the formation of such oxide or nitride as much as possible, and the formation of oxide or nitride is suppressed by controlling the addition amount of Zn and B and the hydrogen ratio during the annealing, such that the magnetism is improved.

Specifically, the hydrogen gas content ratio in the atmosphere gas may satisfy the following Equation 1.

$$0.01 \leq ([Zn]+[B]) \times 100/[H_2] \leq 0.06 \quad \text{[Equation 1]}$$

(In Equation 1, [Zn] and [B] denote the contents (wt %) of Zn and B, respectively, and $[H_2]$ denotes a hydrogen gas content (volume %) in the atmosphere gas.)

In the final annealing process, all of the processed texture formed in the cold rolling of the previous step may be recrystallized (i.e., over 99%). The average grain size of the crystal grains of the final annealed steel sheet may be 50 to 150 μm.

The non-grain oriented electrical steel sheet thus produced may be treated with an insulating coating. The insulating coating may be an organic, inorganic, or organic/inorganic composite coating, or may be other insulating coatings for insulation.

Hereinafter, the present invention is described in more detail through examples. However, these examples are merely to illustrate the present invention, and the present invention is not limited thereto.

EXAMPLES

The composite as shown in the following Table 1 and Table 2 is provided, and the slab including the balance of Fe and the inevitable impurities is manufactured. The slab is heated to 1140° C. and hot rolled with a finishing temperature of 880° C. to manufacture the heat rolled sheet with a sheet thickness of 2.5 mm. The heat rolled sheet that is hot rolled is annealed at 1030° C. for 100 seconds, and is pickled and cold rolled to make the thickness of 0.50 mm and the final annealing is performed at 1020° C. for 100 seconds. In the final annealing process, the atmosphere gas is a mixed gas of hydrogen gas and nitrogen gas, and a hydrogen gas ratio is changed as shown in the following Table 3.

After the final annealing, the density of a Si oxide formed on the steel sheet surface and having a particle diameter of 50 to 200 nm is measured, and is summarized in the following Table 3, and the magnetic flux density ($B_{50}$) and the iron loss ($W_{15/50}$) for each specimen are also shown in the following Table 3. The iron loss ($W_{15/50}$) is an average loss (W/kg) in the rolling direction and the direction perpendicular to the rolling direction when the magnetic flux density of 1.5 Tesla is induced in a 50 Hz frequency, and the magnetic flux density ($B_{50}$) is a magnitude (Tesla) of the magnetic flux density induced when a magnetic field of 5000 A/m is applied.

TABLE 1

| Steel kind (wt %) | Si | Mn | Al | Zn | B |
|---|---|---|---|---|---|
| A1 | 1.64 | 0.21 | 0.19 | 0.003 | 0.0037 |
| A2 | 1.98 | 0.59 | 0.15 | 0.0005 | 0.0009 |
| A3 | 2.23 | 0.29 | 0.75 | 0.0049 | 0.0029 |
| A4 | 3.16 | 0.75 | 0.5 | 0.0028 | 0.0033 |
| A5 | 1.32 | 0.34 | 0.52 | 0.0035 | 0.0002 |
| A6 | 2.22 | 0.41 | 0.37 | 0.011 | 0.0019 |
| A7 | 2.71 | 0.44 | 0.34 | 0.0025 | 0.0013 |
| A8 | 2.87 | 0.63 | 0.81 | 0.0014 | 0.0017 |
| A9 | 3.14 | 0.56 | 0.34 | 0.0008 | 0.0004 |
| A10 | 2.89 | 0.32 | 0.66 | 0.0014 | 0.0018 |
| A11 | 3.33 | 0.16 | 0.33 | 0.0025 | 0.0014 |
| A12 | 2.53 | 0.18 | 0.44 | 0.0015 | 0.0062 |

TABLE 2

| Steel kind (wt %) | P | C | S | N | Ti | Sn | Sb |
|---|---|---|---|---|---|---|---|
| A1 | 0.04 | 0.001 | 0.0016 | 0.0037 | 0.0013 | 0.02 | 0.03 |
| A2 | 0.03 | 0.0029 | 0.0016 | 0.0036 | 0.0019 | 0.02 | 0 |
| A3 | 0.02 | 0.0024 | 0.0019 | 0.0013 | 0.0024 | 0 | 0.02 |
| A4 | 0.02 | 0.0016 | 0.002 | 0.0015 | 0.0015 | 0.04 | 0 |
| A5 | 0.04 | 0.0012 | 0.0026 | 0.0019 | 0.0007 | 0 | 0 |
| A6 | 0.05 | 0.001 | 0.0017 | 0.0018 | 0.0027 | 0 | 0.03 |
| A7 | 0.01 | 0.0034 | 0.0032 | 0.0026 | 0.0023 | 0.03 | 0.01 |
| A8 | 0.01 | 6.0027 | 0.003 | 0.002 | 0.0021 | 0.05 | 0 |
| A9 | 0.07 | 0.0007 | 0.0025 | 0.0035 | 0.0011 | 0 | 0.01 |
| A10 | 0.03 | 0.0012 | 0.0035 | 0.0036 | 0.0021 | 0 | 0 |
| A11 | 0.05 | 0.0026 | 0.0028 | 0.0035 | 0.0033 | 0.01 | 0.01 |
| A12 | 0.02 | 0.0031 | 0.0015 | 0.0039 | 0.0012 | 0.03 | 0.02 |

TABLE 3

| Steel kind | $H_2$ ratio (volume %) in annealing atmosphere | ([Zn] + [B]) × 100/$[H_2]$ | Si oxide density (unit/μm$^2$) | Iron loss ($W_{15/50}$, W/kg) | Magnetic flux density ($B_{50}$, T) | |
|---|---|---|---|---|---|---|
| A1 | 39 | 0.017 | 4 | 2.72 | 1.75 | Embodiment Example |
| A2 | 30 | 0.005 | 10 | 3.75 | 1.68 | Comparative Example |
| A3 | 22 | 0.035 | 3 | 2.64 | 1.74 | Embodiment Example |
| A4 | 12 | 0.051 | 2 | 2.18 | 1.7 | Embodiment Example |
| A5 | 40 | 0.009 | 8 | 3.94 | 1.69 | Comparative Example |
| A6 | 17 | 0.076 | 6 | 3.5 | 1.67 | Comparative Example |
| A7 | 21 | 0.018 | 2 | 2.56 | 1.73 | Embodiment Example |

TABLE 3-continued

| Steel kind | $H_2$ ratio (volume %) in annealing atmosphere | ([Zn] + [B]) × 100/[$H_2$] | Si oxide density (unit/μm$^2$) | Iron loss ($W_{15/50}$, W/kg) | Magnetic flux density ($B_{50}$, T) | |
|---|---|---|---|---|---|---|
| A8 | 5 | 0.062 | 7 | 3.29 | 1.65 | Comparative Example |
| A9 | 20 | 0.006 | 14 | 3.03 | 1.65 | Comparative Example |
| A10 | 24 | 0.013 | 3 | 2.34 | 1.71 | Embodiment Example |
| A11 | 15 | 0.026 | 4 | 2.14 | 1.7 | Embodiment Example |
| A12 | 12 | 0.064 | 8 | 3.33 | 1.67 | Comparative Example |

As shown in Table 1 to Table 3, in the cases of A1, A3, A4, A7, A10, and A11 in which the contents of Zn and B are appropriately included and the hydrogen ratio within the atmosphere gas during the final annealing is appropriately included, the density of the Si oxide is appropriately formed, and the iron loss $W_{15/50}$ and the magnetic flux density $B_{50}$ are excellent.

On the other hand, for A2 and A6, Zn does not satisfy the management range, the hydrogen ratio within the atmosphere gas during the final annealing is not appropriately included, and a large amount of the Si oxide is produced, and as a result, the iron loss $W_{15/50}$ and the magnetic flux density $B_{50}$ are inferior.

For A5 and A12, B does not satisfy the management range, the hydrogen ratio within the atmosphere gas during the final annealing is not appropriately included, and a large amount of the Si oxide is produced, and as a result, the iron loss $W_{15/50}$ and the magnetic flux density $B_{50}$ are inferior For A8, Zn and B satisfy each management range, however the hydrogen ratio within the atmosphere gas during the final annealing is not appropriately included, and a large amount of the Si oxide is produced, and as a result, the iron loss $W_{15/50}$ and the magnetic flux density $B_{50}$ are inferior.

Also, for A9, Zn and B do not satisfy each management range, the hydrogen ratio within the atmosphere gas during the final annealing is not appropriately included, and a large amount of the Si oxide is produced, and as a result, the iron loss $W_{15/50}$ and the magnetic flux density $B_{50}$ are inferior.

While this invention has been described in connection with what is presently considered to be practical exemplary embodiments, it is to be understood that the invention is not limited to the disclosed embodiments. On the contrary, it is intended to cover various modifications and equivalent arrangements included within the spirit and scope of the appended claims.

The invention claimed is:

1. A non-grain oriented electrical steel sheet comprising Si: 1.0 to 4.0%, Mn: 0.1 to 1.0%, Al: 0.1 to 1.5%, Zn: 0.001 to 0.01%, B: 0.0005 to 0.005% by wt %, and a balance including Fe and inevitable impurities, wherein for a surface of the steel sheet a density of a Si oxide with a particle diameter of 50 to 200 nm is 5 units/μm$^2$ or less.

2. The non-grain oriented electrical steel sheet of claim 1, further comprising P: 0.001 to 0.1 wt %, C: 0.005 wt % or less, S: 0.001 to 0.005 wt %, N: 0.005 wt % or less, and Ti: 0.005 wt % or less.

3. The non-grain oriented electrical steel sheet of claim 1, further comprising one or more of Sn and Sb alone or as a sum amount of 0.06 wt % or less.

4. The non-grain oriented electrical steel sheet of claim 1, further comprising one or more of Cu: 0.05 wt % or less, Ni: 0.05 wt % or less, Cr: 0.05 wt % or less, Zr: 0.01 wt % or less, Mo: 0.01 wt % or less, and V: 0.01 wt % or less.

5. The non-grain oriented electrical steel sheet of claim 1, wherein an iron loss ($W_{15/50}$) is 2.80 W/kg or less, and a magnetic flux density $B_{50}$ is 1.70 T or more.

6. A manufacturing method of a non-grain oriented electrical steel sheet comprising:

a step of heating a slab including Si: 1.0 to 4.0%, Mn: 0.1 to 1.0%, Al: 0.1 to 1.5%, Zn: 0.001 to 0.01%, B: 0.0005 to 0.005% and a balance including Fe and inevitable impurities by wt %;

a step of hot-rolling the slab to manufacturing a heat rolled sheet; a step of cold roiling the heat rolled sheet to manufacturing a cold roiled sheet; and a step of final annealing the cold rolled sheet;

wherein the step of the final annealing includes a hydrogen gas as an atmosphere gas and a content ratio of the hydrogen gas within the atmostpher gas satisfies the following Equation 1:

$$0.01 \leq ([Zn]+[B]) \times 100/[H_2] \leq 0.06 \quad \text{[Equation 1]}$$

wherein in Equation 1, [Zn] and [B] represent each content by wt % of Zn and B, and [$H_2$] represents a content by vol % of hydrogen gas within an atmosphere gas, thereby producing the non-grain oriented electrical steel sheet of claim 1.

7. The manufacturing method of the non-grain oriented electrical steel sheet of claim 6, wherein the slab further includes P: 0.001 to 0.1 wt %, C: 0.005 wt % or less, S; 0.001 to 0.005 wt %, N: 0.005 wt % or less, and Ti: 0.005 wt % or less.

8. The manufacturing method of the non-grain oriented electrical steel sheet of claim 6, wherein the slab further includes one kind or more of Sn and Sb alone or as a sum amount of 0.06 wt % or less.

9. The manufacturing method of the non-grain oriented electrical steel sheet of claim 6, wherein the slab further includes one kind or more of Cu: 0.05 wt % or less, Ni: 0.05 wt % or less, Cr: 0.05 wt % or less, Zr: 0.01 wt % or less, Mo: 0.01 wt % or less, and V: 0.01 wt % or less.

10. The manufacturing method of the non-grain oriented electrical steel sheet of claim 6, further comprising, after the step of manufacturing the heat rolled sheet, a step of annealing the heat rolled sheet.

* * * * *